US008300873B2

(12) United States Patent
Qiao et al.

(10) Patent No.: US 8,300,873 B2
(45) **Date of Patent: *Oct. 30, 2012**

(54) LOW PROFILE GREETING CARD SPEAKER

(75) Inventors: Tiger Qiao, Shanghai (CN); Jerry Guo, Shanghai (CN); Eva Jin, Shanghai (CN)

(73) Assignee: American Greetings Corporation, Cleveland, OH (US)

( * ) Notice: Subject to any disclaimer, the term of this patent is extended or adjusted under 35 U.S.C. 154(b) by 73 days.

This patent is subject to a terminal disclaimer.

(21) Appl. No.: 12/836,032

(22) Filed: Jul. 14, 2010

(65) Prior Publication Data

US 2011/0110554 A1 May 12, 2011

(51) Int. Cl.
*H04R 25/00* (2006.01)

(52) U.S. Cl. ..... 381/396; 381/412; 381/433

(58) Field of Classification Search ..... 381/152, 381/386, 395, 396, 398, 403, 404, 407, 412, 381/416, 420, 431, 432, 433
See application file for complete search history.

(56) References Cited

U.S. PATENT DOCUMENTS

| | | | | |
|---|---|---|---|---|
| 2,537,723 | A * | 1/1951 | Ward | 381/432 |
| 5,239,589 | A | 8/1993 | Yang et al. | |
| 5,625,701 | A * | 4/1997 | Scanlan | 381/403 |
| 6,181,799 | B1 | 1/2001 | Azima et al. | |
| 6,359,991 | B1 | 3/2002 | Azima et al. | |
| 7,016,514 | B2 * | 3/2006 | White et al. | 381/397 |
| 7,227,966 | B2 | 6/2007 | Kobayashi | |
| 7,382,893 | B2 * | 6/2008 | Baeten | 381/416 |
| 2009/0205230 | A1 | 8/2009 | Driessen | |

* cited by examiner

*Primary Examiner* — Huyen D Le
(74) *Attorney, Agent, or Firm* — James C. Scott; Roetzel & Andress

(57) ABSTRACT

A low profile miniature speaker configured for use in greeting cards such as sound generating greeting cards and other novelties. The thickness of the speaker is minimized while maintaining the sound quality and increasing strength. The speaker magnet is counter-sunk into the housing of the speaker, thereby decreasing overall thickness. The speaker is configured with concentric ribs that radiate outward from the center of the circular speaker. The ribs reinforce the plastic housing and increase the structural strength of the speaker.

15 Claims, 3 Drawing Sheets

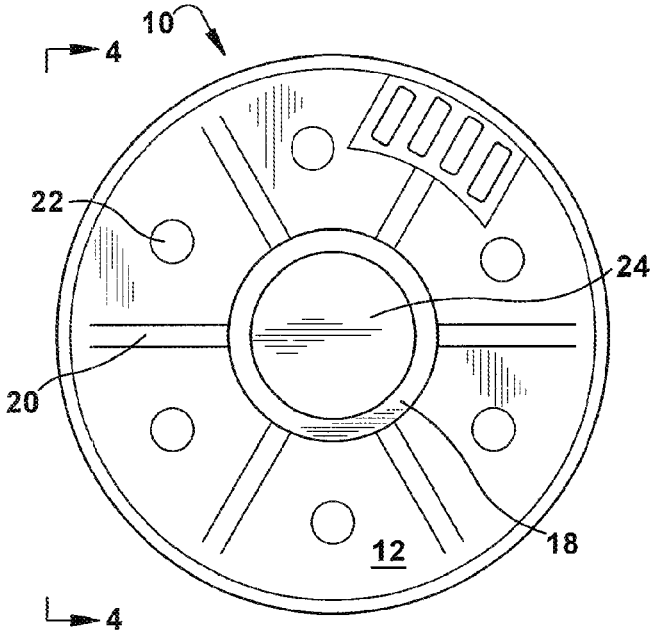
Fig. 3
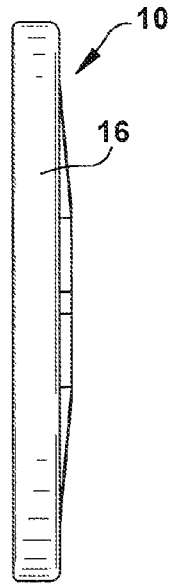
Fig. 4
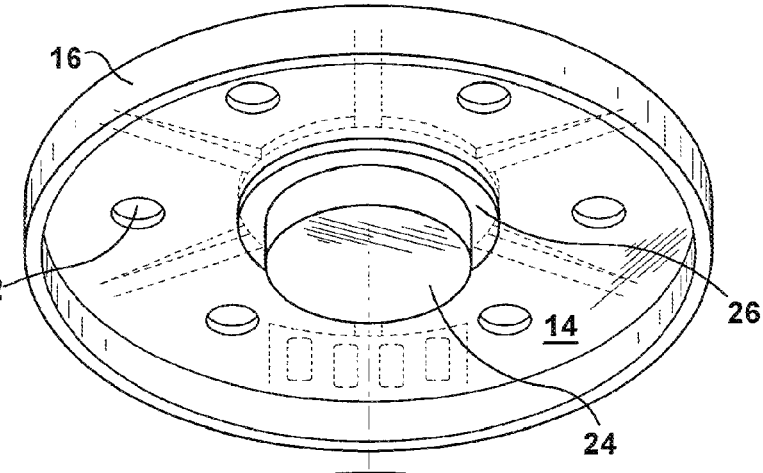
Fig. 5
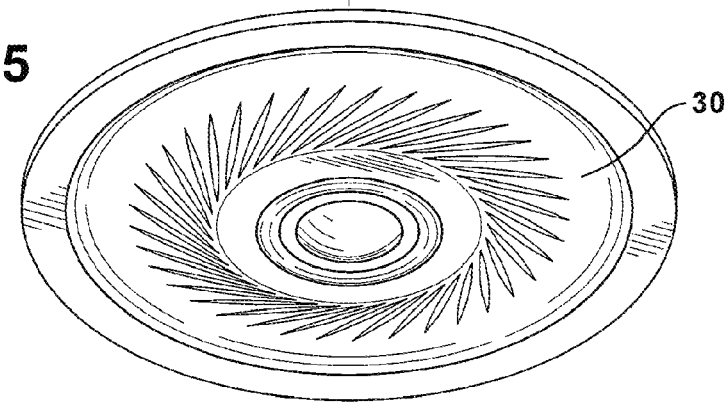

LOW PROFILE GREETING CARD SPEAKER

RELATED APPLICATIONS

There are no applications related to this application.

FIELD OF THE INVENTION

The present invention and related disclosure is related to miniature loudspeakers, and more specifically to low profile miniature loudspeakers that are used in electronic greeting cards.

BACKGROUND OF THE INVENTION

Miniature loudspeakers (also referred to herein as speakers) are used in electronic greeting cards and other novelty devices to turn electronic signals into sound. These devices typically use a small electronic circuit that is contained and concealed between layers the greeting card. The electric circuit will usually comprise a silicon chip, a battery, a switch and a speaker. The switch typically activates the circuit when the greeting card is opened. The battery powers the circuit and the speaker produces sound by using an electromagnet to generate vibrations in the air with a small diaphragm. Discrete music data, stored in the memory portion of the chip, is converted into voltage signals that are changing up and down quickly which, when fed through the speaker, cause the diaphragm to vibrate, generating sound. The components of the miniature speaker are typically contained within a small round plastic housing with openings thereon. Additionally, the electromagnet is contained within a circular open encasement that sits above and in the center of the substantially planar surface of the housing. Since greeting cards are often sent through the mail and otherwise delivered in envelopes, it is important that the thickness of the speaker is minimized so that the greeting cards may fit through appropriate mail slots and the strength of the speaker housing is maximized to avoid destruction of the greeting card sound module during mail delivery.

SUMMARY OF THE INVENTION

The low profile miniature speaker of the present invention and related disclosure includes a speaker housing having a circular shape with a first surface, a second surface opposite the first surface and a perimeter wall that extends perpendicularly from the perimeter of the second surface to create a sunken second surface, the speaker housing having a major aperture at the center of the housing and at least six minor apertures arranged concentrically about the first aperture. The first surface of the speaker housing contains a slightly raised circular rib about the major aperture and at least six linear ribs radiating outward from the circular rib, each of the at least six linear ribs located between each pair of the at least six apertures. A circular magnet is located within the major aperture of the speaker housing, the magnet being flush with the slightly raised circular rib on the first surface of the speaker housing. A thin circular diaphragm member is located over the second surface of the speaker housing and is attached to the perimeter wall. The entire speaker is approximately 4.5 mm thick. An improved low profile structure of a speaker is disclosed which is integrated more easily into more types of greeting card constructions with reduced or minimized profile. These and other advantages of the disclosure and related inventions are further described herein.

DESCRIPTION OF THE DRAWINGS

FIG. 3 is a top view of the speaker of FIG. 2.

FIG. 4 is a profile view of the speaker of FIG. 3.

FIG. 5 is an exploded view of the speaker of FIG. 2.

DETAILED DESCRIPTION OF PREFERRED AND ALTERNATE EMBODIMENTS

Figure 1:
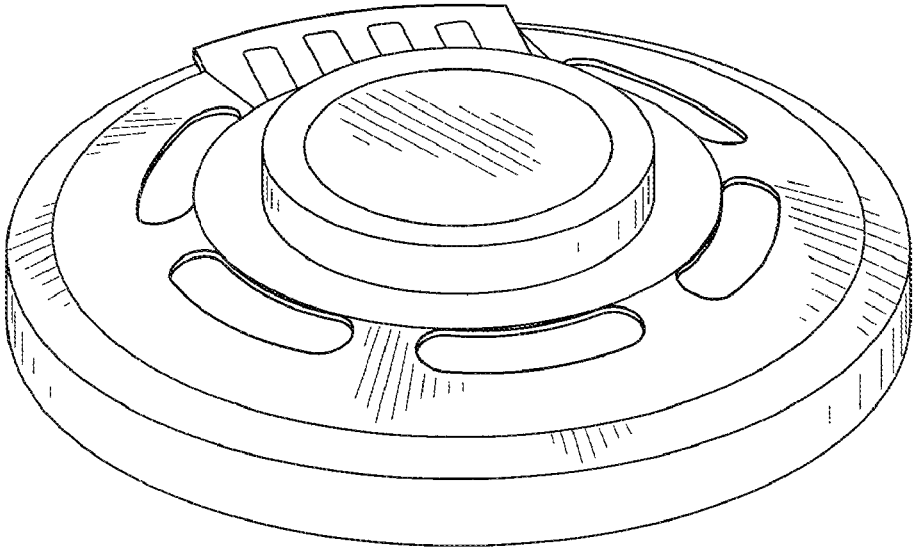
Fig. 1 (Prior Art)
FIG. 1 shows a speaker with protruding electromagnet of the prior art.
Figure 2:
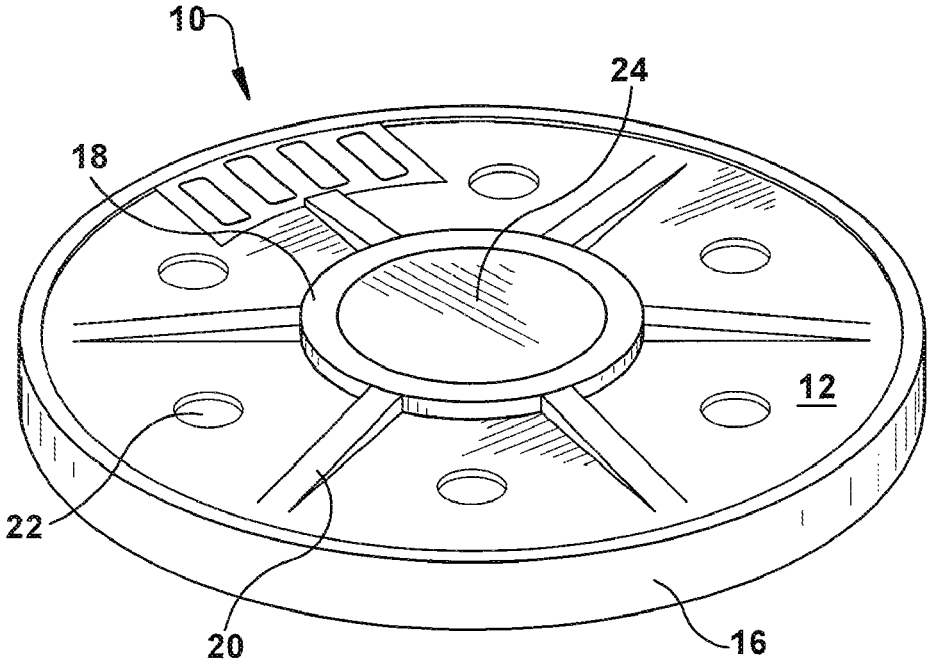
FIG. 2 shows a perspective view of an improved low profile speaker according to the present invention.

Low profile speakers of the type described herein are used in sound generating greeting cards and other novelty items. To serve this purpose, the speakers must generally be small in both diameter and thickness and must be relatively lightweight so they can easily be concealed between two or more panels of a greeting card and so as to not add excess weight to the greeting card. Since greeting cards are often sent by mail and otherwise delivered in envelopes, the speakers must also be strong and impact resistant, and preferably have a minimal or reduced profile. A low profile speaker in accordance with the present invention is comprised of a rigid circular housing which protects the internal components, namely, the voice coil, magnet and diaphragm. In a preferred embodiment, the speaker is approximately 40 mm in diameter and has a total overall thickness of approximately 4.5 mm. The speaker also has a net weight of between approximately 4.5 g and 5.0 g.

A representative speaker 10 according to the present invention is shown in FIGS. 2 through 6. The circular plastic housing has an outer surface 12, an inner surface 14 and a perimeter wall 16 that extends outward from the inner surface 14 in a perpendicular direction and extends about circular perimeter of the housing. The housing also contains a circular cutout area at the center of the housing. In a preferred embodiment, the circular cutout area is approximately 15.5 mm. A slightly raised circular rib 18 exists on both the outer 12 and inner surfaces 14 of the housing that extends around the perimeter of the circular cutout area. Six or more spaced apart linear ribs 20 radiate outward from the slightly raised circular rib 18 on the outer surface 12 of the housing. Six or more apertures 22 or openings are concentrically arranged about the body of the plastic housing and extend through the housing. Each aperture or opening 22 exists between each pair of linear ribs 20 radiating outward from the center of the housing on the outer surface 12 of the housing. The ribs 20 serve to strengthen the housing and provide a higher resistance to damage and general wear and tear. In a preferred embodiment, there are at least six ribs 20 and at least six apertures or openings 22.

A circular magnet 24, having a first surface and a second surface opposite the first surface, is inserted into the circular cutout area at the center of the speaker housing so that it completely fills the cutout area and sits flush with the slightly raised circular rib 18 about the inner and outer surface perimeter of the circular cutout area, thereby creating a magnet 24 that is "sunken" into the plastic speaker housing. In a preferred embodiment, the magnet 24 is a permanent magnet made of ceramic, ferrite, Alnico or rare earth magnets. In the prior art, shown in FIG. 1, the magnet protruded from the top of the outer surface of the housing, creating a thicker profile.

The magnet 24 contains a thin circular channel 26 proximate to the perimeter of the magnet 24 on the inside surface 14 of the magnet housing. A circular ring of metal, referred to as a voice coil 28, sits within the circular channel 26. Although the voice coil 28 and the magnet channel 26 are described as being circular, they may be rectangular or any other shape, giving varying amounts of coil volume coverage in the magnetic channel space. The voice coil 28 is co-axially oriented inside the channel 26 and moves back and forth within the channel 26. The channel 26 establishes a concentric magnetic field between the two poles of the magnet 24. The voice coil 28 may be made of copper, aluminum or even silver.

Figure 6:
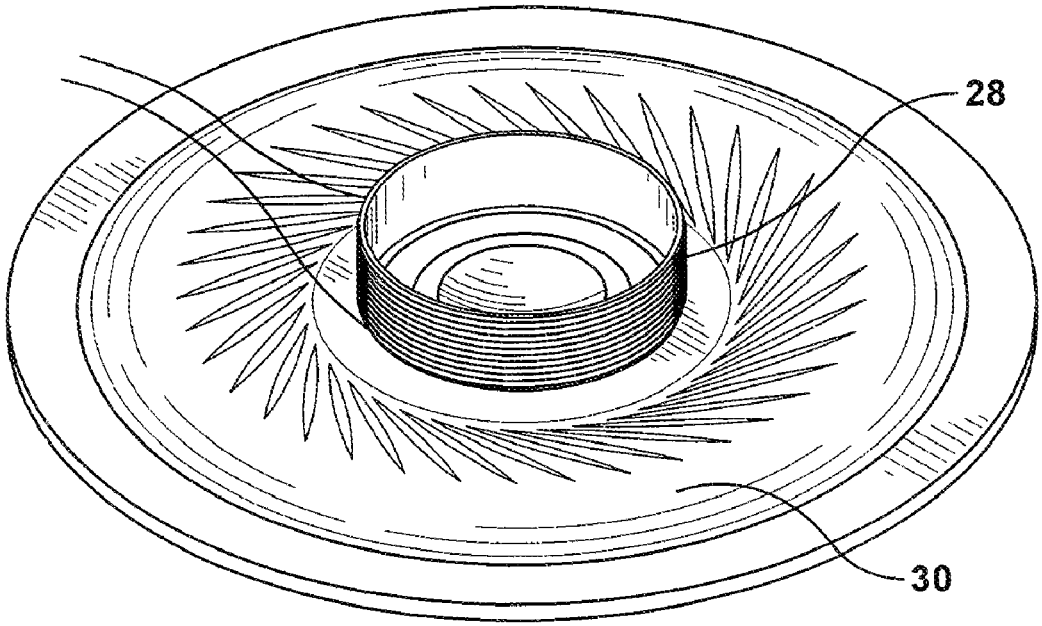
FIG. 6 is a perspective view of the inside of the diaphragm with attached voice coil of the speaker of FIG. 2.

The top surface of the circular voice coil is connected to a diaphragm 30, as shown in FIG. 6. The diaphragm 30 is a thin piece of material that extends over the entire inside surface 14 of the circular plastic speaker housing and is sealed about the perimeter wall 16 that extends outward from the inner surface 14 around the perimeter of the housing. The diaphragm 30 must be made of a stiff material to prevent uncontrolled motions but also lightweight to minimize the force requirement and well damped, to reduce the vibrations from continuing after the signal has stopped. A variety of materials can be used, such as paper, plastic or metal.

The low profile speaker of the present invention minimizes the total thickness of the speaker and maximizes the strength while maintaining the sound quality. The speaker was tested for compressive strength by placing a sample between two parallel plates and compressing the plates with the speed of 10 mm/min. The speaker was subjected to both vertical and horizontal pressures. The minimum vertical carrying pressure for the speaker is 250 lbs. and the minimum horizontal carrying pressure is 1000 lbs. This is important because the speaker must be designed to survive the rollers used in the automated mail sorting system.

It is also crucial that while minimizing the thickness of the speaker, the speaker is still capable of producing acceptable sound quality. The speaker has an approximate resonant frequency of between 400-600 HZ and a fundamental frequency of less than 200 HZ.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A low profile miniature speaker comprising:

a speaker housing having a circular shape with first surface, a second surface opposite the first surface and a perimeter wall that extends perpendicularly from the perimeter of the second surface to create a sunken second surface, the speaker housing having a major aperture at the center of the housing and at least six minor apertures arranged concentrically about the major aperture;

the first surface of the speaker housing having a slightly raised circular rib about the major aperture and at least six linear ribs radiating outward from the circular rib, each of the at least six linear ribs located between each pair of the at least six apertures;

a circular magnet located within the major aperture of the speaker housing, the magnet being flush with the slightly raised circular rib on the first surface of the speaker housing;

the entire speaker having a thickness of approximately 4.5 mm.

2. The low profile miniature speaker of claim 1, wherein the diameter of the speaker is approximately 40 mm.

3. The low profile miniature speaker of claim 1, wherein the diameter of the major aperture is approximately 15.5 mm.

4. The low profile miniature speaker of claim 1, wherein the net weight of the speaker is between approximately 4.5 and 5.0 g.

5. The low profile miniature speaker of claim 1, wherein the speaker housing is made of plastic.

6. The low profile miniature speaker of claim 1, wherein the resonance frequency is between about 400 and 600 HZ.

7. The low profile miniature speaker of claim 1, wherein the fundamental frequency is less than about 200 HZ.

8. The low profile miniature speaker of claim 1, wherein the speaker has a minimum vertical carrying pressure of approximately 250 lbs.

9. The low profile miniature speaker of claim 1, wherein the speaker has a minimum horizontal carrying pressure of approximately 1000 lbs.

10. A low profile miniature speaker comprising:

a disk-shaped housing having a major opening at a center of the housing and at least six minor openings arranged concentrically around the major opening at the center of the housing, an inner surface, an outer surface and a wall that extends about the perimeter of the housing;

a circular rib located on the outer surface of the disk-shaped housing and positioned about the perimeter of the major opening at the center of the housing;

at least six ribs located on the outer surface of the disk-shaped housing and extending outward from the circular rib;

a circular magnet located within the major opening at the center of the housing;

a diaphragm member attached to the wall that extends about the perimeter of the housing that conceals the entire inner surface of the disk-shaped housing;

the entire speaker having a thickness of approximately 4.5 mm.

11. The low profile miniature speaker of claim 10, wherein the resonance frequency is between about 400 and 600 HZ.

12. The low profile miniature speaker of claim 10, wherein the speaker has a minimum vertical carrying pressure of approximately 250 lbs.

13. The low profile miniature speaker of claim 10, wherein the speaker has a minimum horizontal carrying pressure of approximately 1000 lbs.

14. The low profile miniature speaker of claim 10, wherein the magnet sits flush with the circular rib located on the outer surface of the housing.

15. A low profile miniature speaker comprising:

a speaker housing having a circular shape with first surface, a second surface opposite the first surface and a perimeter wall that extends perpendicularly from the perimeter of the second surface to create a sunken second surface, the speaker housing having a major aperture at the center of the housing and at least six minor apertures arranged concentrically about the major aperture;

the first surface of the speaker housing having a slightly raised, circular rib about the major aperture and at least six linear ribs radiating outward from the circular rib, each of the at least six linear ribs located between each pair of the at least six apertures;

a circular magnet located within the major aperture of the speaker housing, the magnet being flush with the slightly raised circular rib on the first surface of the speaker housing;

the entire speaker having a thickness of approximately 4.5 mm.

* * * * *